US007316493B2

(12) United States Patent
Kinoshita

(10) Patent No.: US 7,316,493 B2
(45) Date of Patent: Jan. 8, 2008

(54) HEADLAMP FOR VEHICLE

(75) Inventor: Masao Kinoshita, Shizuoka (JP)

(73) Assignee: Koito Manufacturing Co. Ltd., Tokyo (JP)

( * ) Notice: Subject to any disclaimer, the term of this patent is extended or adjusted under 35 U.S.C. 154(b) by 0 days.

(21) Appl. No.: 11/505,903

(22) Filed: Aug. 18, 2006

(65) Prior Publication Data

US 2007/0047250 A1 Mar. 1, 2007

(30) Foreign Application Priority Data

Aug. 23, 2005 (JP) ..... P. 2005-241843

(51) Int. Cl.
*B60Q 1/00* (2006.01)

(52) U.S. Cl. ..... 362/539; 362/517; 362/299; 362/346

(58) Field of Classification Search ..... 362/298, 362/299, 303, 346, 517–519, 538, 539
See application file for complete search history.

(56) References Cited

U.S. PATENT DOCUMENTS 7,093,966 B2 * 8/2006 Yamamura et al. ..... 362/539
2006/0062011 A1 * 3/2006 Yamamura ..... 362/517

FOREIGN PATENT DOCUMENTS

JP 2004-127830 A 4/2004
JP 2005-100766 A 4/2005

* cited by examiner

*Primary Examiner*—Stephen F. Husar
(74) *Attorney, Agent, or Firm*—Sughrue Mion, PLLC

(57) ABSTRACT

A headlamp including a first addition reflector 34 and a second addition reflector. The first addition reflector is arranged between a light source bulb 22 and a shade 32 and reflects light that is sent from a light source 22*a* toward a front region in a bulb insertion direction on a reflecting face 24*a* of a main reflector 24. The second addition reflector 36 reflects light, which is reflected on the first addition reflector 34 being sent from the light source, to the optical axis $A_x$, side. Reflecting faces 34*a*, 36*a* of the addition reflectors 34, 36 can be divided into upper stage reflecting portions 34*a*1, 36*a*1 and lower stage reflecting portions 34*a*2, 36*a*2.

20 Claims, 8 Drawing Sheets

HEADLAMP FOR VEHICLE

This application claims foreign priority from Japanese Patent Application No. 2005-241843, filed Aug. 23, 2005, the entire contents of which are hereby incorporated by reference.

BACKGROUND OF THE INVENTION

1. Field of the Invention

The present invention relates to a projector type headlamp for a vehicle. More particularly, the present invention relates to a headlamp for a vehicle that forms a low beam light distribution pattern.

2. Related Art

In general, a projector type headlamp for a vehicle is composed as follows. A projection lens is arranged on an optical axis extending in the longitudinal direction of the vehicle, and a light source is arranged at the rear of a rear side focus of the projection lens. Light emitted from this light source is reflected by a reflector and is converged toward an optical axis. In the case of a headlight for a vehicle which is used for producing a low beam, a portion of the reflected light sent from the reflector is shaded by a shade arranged so that an upper end edge of the shade is located at a position close to the rear side focus of the projection lens.

JP-A-2004-127830. ("JP '830") describes a side insertion type projector type headlamp for a vehicle. In this type of headlamp, a linear light source extends in an axial direction of the light source bulb, which is inserted and fixed to the reflector from a side of the optical axis.

The headlamp for a vehicle described in JP-A-2005-100766 ("JP '766") includes a first addition reflector, which is arranged between the light source bulb and the shade and reflects light that is sent from the light source toward a front region in the bulb insertion direction, and a second addition reflector, which is above the front region in the bulb insertion direction and reflects light that is reflected by the first addition reflector forward while converging the light toward the optical axis.

When the side insertion type lighting device structure described in JP '830 is employed, it is possible to make the lighting device compact by reducing a length in the longitudinal direction of the lighting device. However, because the light source is composed as a linear light source extending in the bulb axis direction, an amount of light incident upon a front region in the bulb insertion direction on the reflecting face of the reflector is extremely small. Accordingly, it is impossible to ensure a sufficient brightness of the light distribution pattern for a low beam. This is because the light distribution characteristics of the linear light source provide a high luminous intensity in the direction perpendicular to the bulb axis and a low luminous intensity in the direction of the bulb axis.

When the lighting device structure described in JP '766, in which the first and these second addition reflectors are provided, is employed, the light that is directly sent from the light source that would be shaded by the shade is made to be incident upon a projection lens by the first and the second addition reflectors. Thus, incident light can be effectively used as light for irradiating forward. In this case, according to the headlamp for a vehicle described in JP '766, a surface shape of the reflecting face of the first addition reflector is formed into an ellipsoid of revolution, the first focus of which is at a position of the light source and the second focus of which is at a position between the first addition reflector and the second addition reflector. Therefore, a surface shape of the second addition reflector can be set based on the assumption that a virtual light source is arranged at the second focus of the first addition reflector. Due to the foregoing, the light distribution can be easily controlled.

However, the following problems may be encountered. When the surface shape of the reflecting face of the first addition reflector is formed into a shape of an ellipsoid of revolution, radiation heat emitted from the light source is concentrated upon the second focus. Accordingly, the second addition reflector located close to this second focus tends to be heated to a high temperature. Therefore, an undercoat of a vapor-deposited film forming the reflecting face of the second addition reflector is quickly deteriorated by an influence of the radiation heat emitted from the light source.

The present invention has been designed in view of the above circumstances.

SUMMARY OF THE INVENTION

A first aspect of the invention is a headlamp for a vehicle including a projection lens arranged on an optical axis extending in the longitudinal direction of the vehicle; a light source arranged at the rear of a rear side focus of the projection lens; a main reflector for reflecting light, which is sent from the light source, toward a front side while the reflected light is converged toward the optical axis; and a shade, which is arranged close to a rear side focus of the projection lens so that an upper end edge of the shade is located close to the optical axis, the shade reflecting a portion of the reflected light sent from the main reflector. The light source is a linear light source extending in the axial direction of the bulb in the light source bulb and is inserted and fixed to the main reflector from a side of the optical axis.

A first addition reflector for reflecting light, which is sent from the light source, toward a front region in a bulb insertion direction on a reflecting face of the main reflector, is arranged between the light source bulb and the shade. A second addition reflector for reflecting light, which is reflected on the first addition reflector, is provided at a front region in the bulb insertion direction.

A reflecting face of the first addition reflector is divided into a plurality of reflecting portions, and a surface shape of each reflecting portion is formed as an ellipsoid of revolution. A first focus of each of the reflecting portions is the position of the light source, and a second focus of each of the reflecting portions is at a position between the first addition reflector and the second addition reflector. The positions of the respective second focuses are different from one another. A reflecting face of the second addition reflector is divided into a plurality of reflecting portions, and the reflected light sent from the reflecting portions of the first addition reflector is incident upon the reflecting portions of the second addition reflector.

The type of the above "light source bulb" is not specifically limited. For example, a discharge bulb or halogen lamp can be employed. The light source bulb can be inserted and fixed to the main reflector from the side of the optical axis, but the specific inserting and fixing position is not particularly limited.

The aforementioned "front region in the bulb insertion direction" is a reflecting region located on the reflecting face of the main reflector at a position in front of the light source bulb in the inserting direction of the light source bulb. The reflecting region is provided at a position where the bulb axis of the light source bulb crosses the reflecting face of the main reflector, but the specific range of "front region in the bulb insertion direction" is not particularly limited.

The number of the plurality of reflecting portions, the arrangement of the plurality of reflecting portions and the size of each reflecting portion are not specifically limited for the reflecting portions of the "first addition reflector" and the "second addition reflector."

The "second addition reflector" may be formed integrally with the main reflector as one body. Alternatively, this "second addition reflector" may be formed separately from the reflector.

Other aspects and advantages of the invention will be apparent from the following description and the appended claims.

BRIEF DESCRIPTION OF THE DRAWINGS

The advantages, nature, and various additional features of the invention will appear more fully upon consideration of the exemplary embodiment and variations thereof. The exemplary embodiment and variations thereof are set forth in the following drawings.

DETAILED DESCRIPTION OF THE EXEMPLARY EMBODIMENTS

Although the invention will be described with respect to exemplary embodiment and variations thereof, the following exemplary embodiment and variations thereof do not limit the invention.

Figure 1:
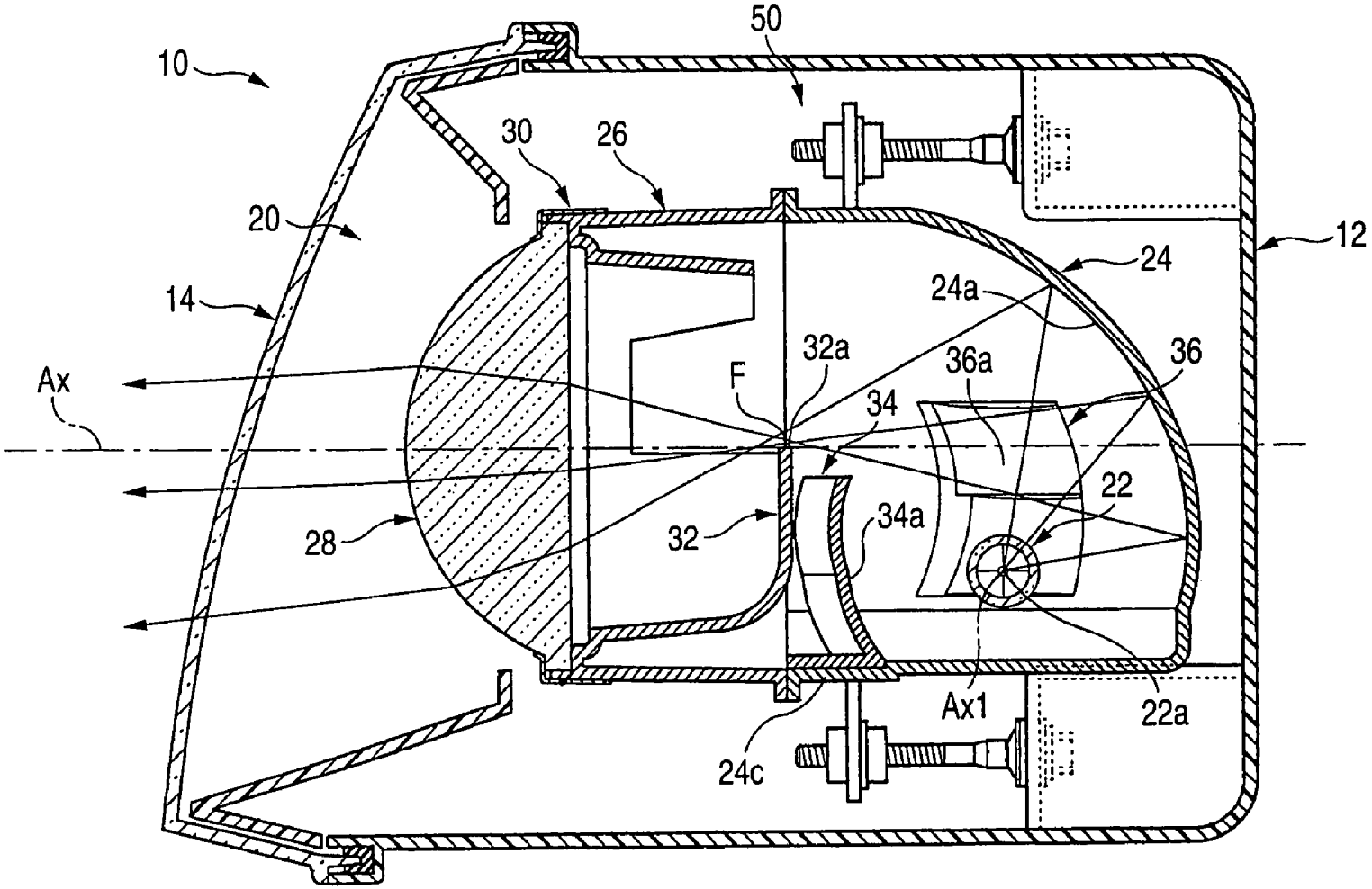
FIG. 1 is a sectional side view showing a headlamp for vehicle use of an exemplary embodiment of the present invention.

FIG. 1 is a sectional side view showing a headlamp 10 for vehicle use of an exemplary embodiment of the present invention.

The headlamp 10 shown in the drawing is a headlamp for vehicle use arranged at a right front end portion of a vehicle. A lighting chamber includes a lamp body 12 and a transparent cover 14 attached to a front end opening portion of the lamp body 12. A lighting device unit 20 having an optical axis $A_x$, extending in the longitudinal direction of a vehicle is accommodated in the lighting chamber via an aiming mechanism 50, which is capable of rotating in the vertical and traverse direction.

After an aiming adjustment has been completed by this aiming mechanism 50, the optical axis $A_x$, of the lighting device unit 20 extends in a direction inclined downward by an angle of 0.5° to 0.6° with respect to the longitudinal direction of a vehicle.

Figure 2:
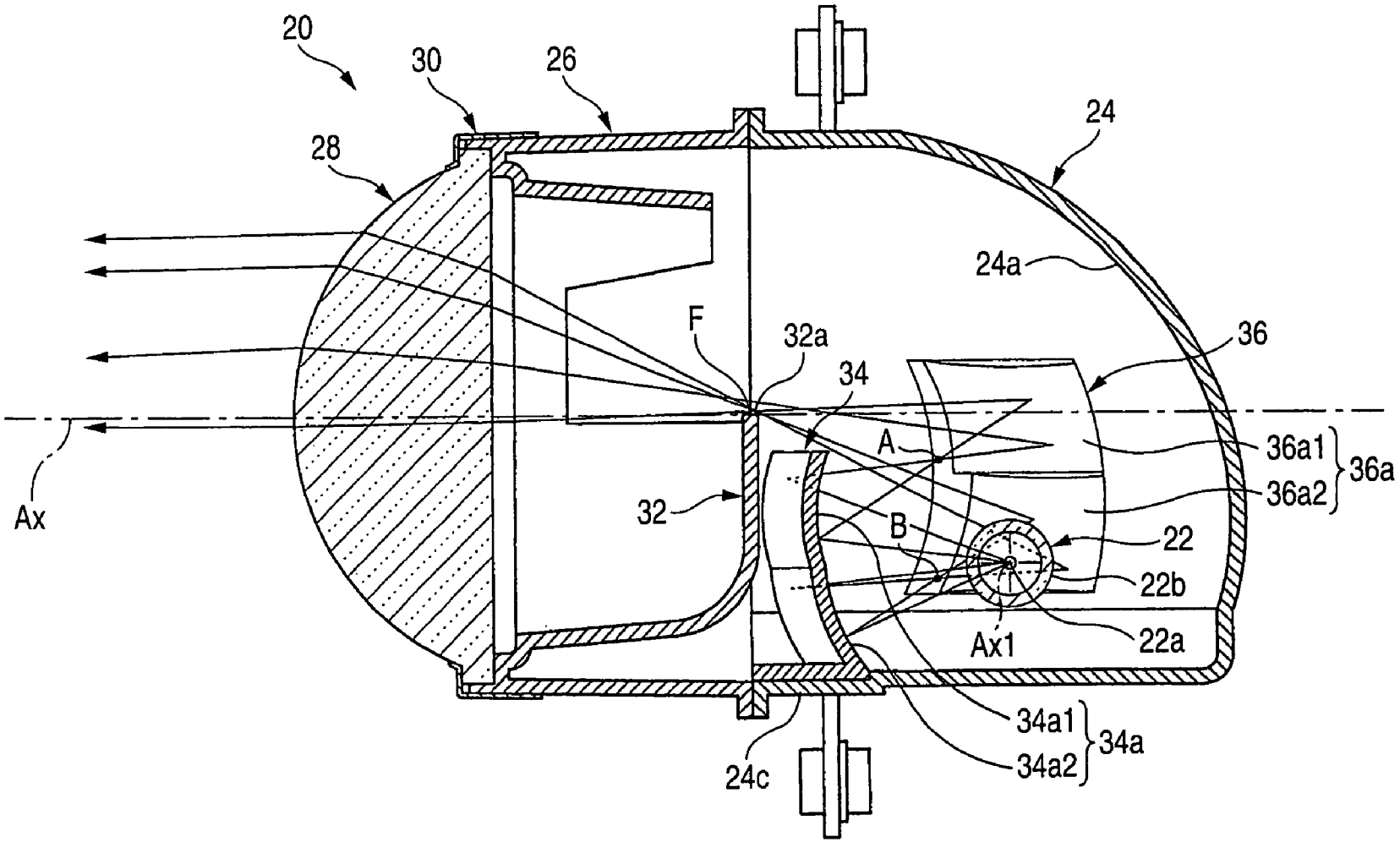
FIG. 2 is a sectional side view showing a lighting device unit of the headlamp for vehicle use, wherein the lighting device unit is shown as a single part.
Figure 3:
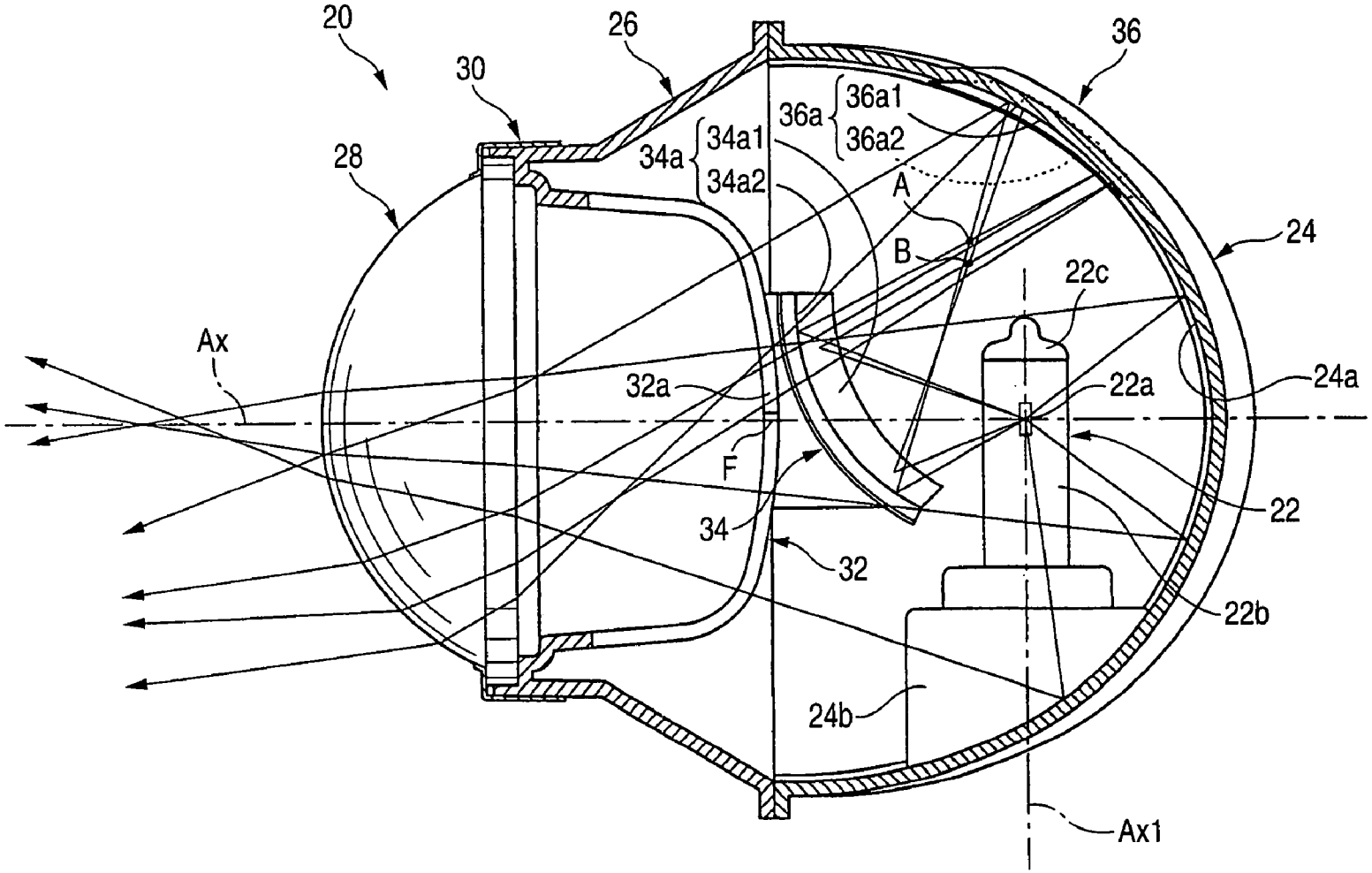
FIG. 3 is a sectional plan view showing the lighting device unit, wherein the lighting device unit is shown as a single part.

FIG. 2 is a sectional side view of the lighting device unit 20 which is shown as a single part, and FIG. 3 is a sectional plan view of the lighting device unit 20 which is shown as a single part.

As illustrated in these drawings, this lighting device unit 20 is a projector type lighting device unit and includes: a light source bulb 22, a main reflector 24, a holder 26, a projection lens 28, a retaining ring 30, a shade 32, a first addition reflector 34 and a second addition reflector 36.

The projection lens 28 is a plano-convex aspherical lens, the front side surface of which is convex and the rear side surface of which is a plane. The projection lens 28 is arranged on the optical axis $A_x$. An image on the focal plane including the rear side focus F of the projection lens 28 is projected forward as a reverse image.

The light source bulb 22 is a halogen bulb, the light source 22*a* of which is a filament. The light source 22*a* is a linear light source extending in the axial direction $A_x$1 of the bulb. This light source bulb 22 is a bulb having a black top; that is, a shading film 22*c* is formed at a forward end portion in the axial direction of the bulb of a transparent glass tube 22*b* which covers the light source 22*a*. At a position on the rear side of the rear side focus F of the projection lens 28 and downward a distance from the optical axis $A_x$ (for example, at a position downward from the optical axis $A_x$ by about 20 mm), this light source bulb 22 is inserted and fixed to the reflector 24 from the left of the optical axis $A_x$. This inserting and fixing is conducted in such a manner that the bulb axis $A_x$1 extends in the horizontal direction on a plane perpendicular to the optical axis $A_x$ so that the light source 22*a* is perpendicularly positioned downward with respect to the optical axis $A_x$ of the light source 22*a*.

The main reflector 24 includes a reflecting face 24*a* for reflecting light, which is sent from the light source 22*a*, toward the front side while converging the light toward the optical axis $A_x$. A cross-section of this reflecting face 24*a* is formed into a substantially elliptical shape containing the optical axis $A_x$. The eccentricity of the ellipse is set so that the eccentricity is gradually increased from the perpendicular cross-section of the reflecting face 24*a* to the horizontal cross-section of the reflecting face 24*a*. Due to the above structure, as shown in FIG. 1, the light sent from the light source 22*a* and reflected on this reflecting face 24*a* is substantially converged close to the rear side focus F on the perpendicular cross-section. Further, as shown in FIG. 3, on the horizontal cross-section, the convergence position is moved considerably forward of the focus F.

In a left lower region of the reflecting face 24*a* of this reflector 24, a bulb inserting and fixing portion 24*b* for inserting and fixing the light source bulb 22 protrudes from the reflecting face 24*a*. In a right side portion of this bulb inserting and fixing portion 24*b*, a bulb insertion hole (not shown) is formed.

The holder 26 is formed so that it extends forward from a front end opening portion of the reflector 24. The holder 26 is formed into a substantial cylindrical shape. In a rear end portion of the holder 26, the main reflector 24 is fixed and supported. In a front end portion of the holder 26, the projection lens 28 is fixed and supported via the retaining ring 30.

The shade 32 is located at a position substantially in the lower half portion of an inside space of the holder 26. The shade 26 is integrally formed with the holder 26 as one body. This shade 32 is composed so that an upper end edge 32*a* of the shade 32 passes through the rear side focus F of the projection lens 28. Due to this structure, a portion of the reflected light sent from the reflecting face 24*a* of the main reflector 24 is shaded. Therefore, most of the upward light that would emerge forward from the projection lens 28 can be removed.

The first addition reflector 34 is arranged between the light source bulb 22 and the shade 32 and is positioned and fixed in a positioning recess portion 24*c* formed on a bottom face wall of the main reflector 24. In this case, the first addition reflector 34 is arranged at a position close to the shade 32, and an upper end edge of the first addition reflector 34 is located at a position a little lower than the optical axis $A_x$.

This first addition reflector 34 is provided so that the direct light sent from the light source 22*a* can be reflected to a bulb inserting direction front region on the reflecting face 24*a* of the main reflector 24. This bulb inserting direction front region on the reflecting face 24*a* of the main reflector 24 is a second addition reflector 36, which reflects the reflected light, which is sent from the first addition reflector 34, forward toward the optical axis $A_x$ side.

The reflecting face 34*a* of the first addition reflector 34 is divided into an upper stage reflecting portion 34*a*1 and a lower stage reflecting portion 34*a*2, which are arranged in an upper and a lower stage. The reflecting face 36*a* of the second addition reflector 36 is also divided into an upper stage reflecting portion 36*a*1 and a lower stage reflecting portion 36*a*2, which are arranged in an upper and a lower stage.

A surface shape of the upper stage reflecting portion 34*a*1 of the first addition reflector 34 is formed into an ellipsoid of revolution, the first focus of which is at a position of the light source 22*a* and the second focus A of which is at a position close to the upper stage reflecting portion 36*a*1 between the upper stage reflecting portion 34*a*1 and the upper stage reflecting portion 36*a*1 of the second addition reflector 36.

On the other hand, a surface shape of the lower stage reflecting portion 34*a*2 of the first addition reflector 34 is also formed into an ellipsoid of revolution, the first focus of which is at a position of the light source 22*a* and the second focus B of which is at a position close to the lower stage reflecting portion 36*a*2 between the lower stage reflecting portion 34*a*2 and the lower stage reflecting portion 36*a*2 of the second addition reflector 36.

The reflecting face 36*a* of the second addition reflector 36 is composed so that a degree of convergence of the reflecting light, which is sent from the lower stage reflecting portion 36*a*2 of the second addition reflector 36, upon the rear side focus F is larger than a degree of convergence of the reflecting light, which is sent from the upper stage reflecting portion 36*a*1 of the second addition reflector 36, upon the rear side focus F.

That is, the upper stage reflecting portion 36*a*1 of the second addition reflector 36 is composed so that the reflected light, which is sent from the upper stage reflecting portion 34*a*1 of the first addition reflector 34, can be reflected as condensed light, which substantially converges close to the upper end edge 32*a* of the shade 32 in the perpendicular direction. Thus, the reflected light, which is sent from the upper stage reflecting portion 34*a*1 of the first addition reflector 34, can be also reflected as substantially parallel light in the horizontal direction. Specifically, a perpendicular cross-section of this upper stage reflecting portion 36*a*1 is formed into an ellipse, the first focus of which is the second focus A (of the upper stage reflecting portion 34*a*1) and the second focus of which is a point close to the upper end edge 32*a* of the shade 32. A horizontal cross-section of this upper stage reflecting portion 36*a*1 is formed into a parabola, the focus of which is the above second focus A (of the upper stage reflecting portion 34*a*1).

On the other hand, the lower stage reflecting portion 36*a*2 of the second addition reflector 36 is composed so that the reflected light, which is sent from the lower stage reflecting portion 34*a*2 of the first addition reflector 34, can be reflected as condensed light, which substantially converges close to the upper end edge 32*a* of the shade 32 in the perpendicular direction. Thus, the reflected light can be reflected as condensed light which substantially converges in the front of the upper end edge 32*a* of the shade 32. Specifically, a perpendicular cross-section of this lower stage reflecting portion 36*a*2 is formed into an ellipse, the first focus of which is the above second focus B (of the lower stage reflecting portion 34*a*2) and the second focus of which is a point close to the upper end edge 32*a* of the shade 32. A horizontal cross-section of this lower stage reflecting portion 36*a*2 is formed into an ellipse, the first focus of which is the above second focus B (of the lower stage reflecting portion 34*a*2) and the second focus of which is a point forward of the upper end edge 32*a* of the shade 32.

Figure 4:
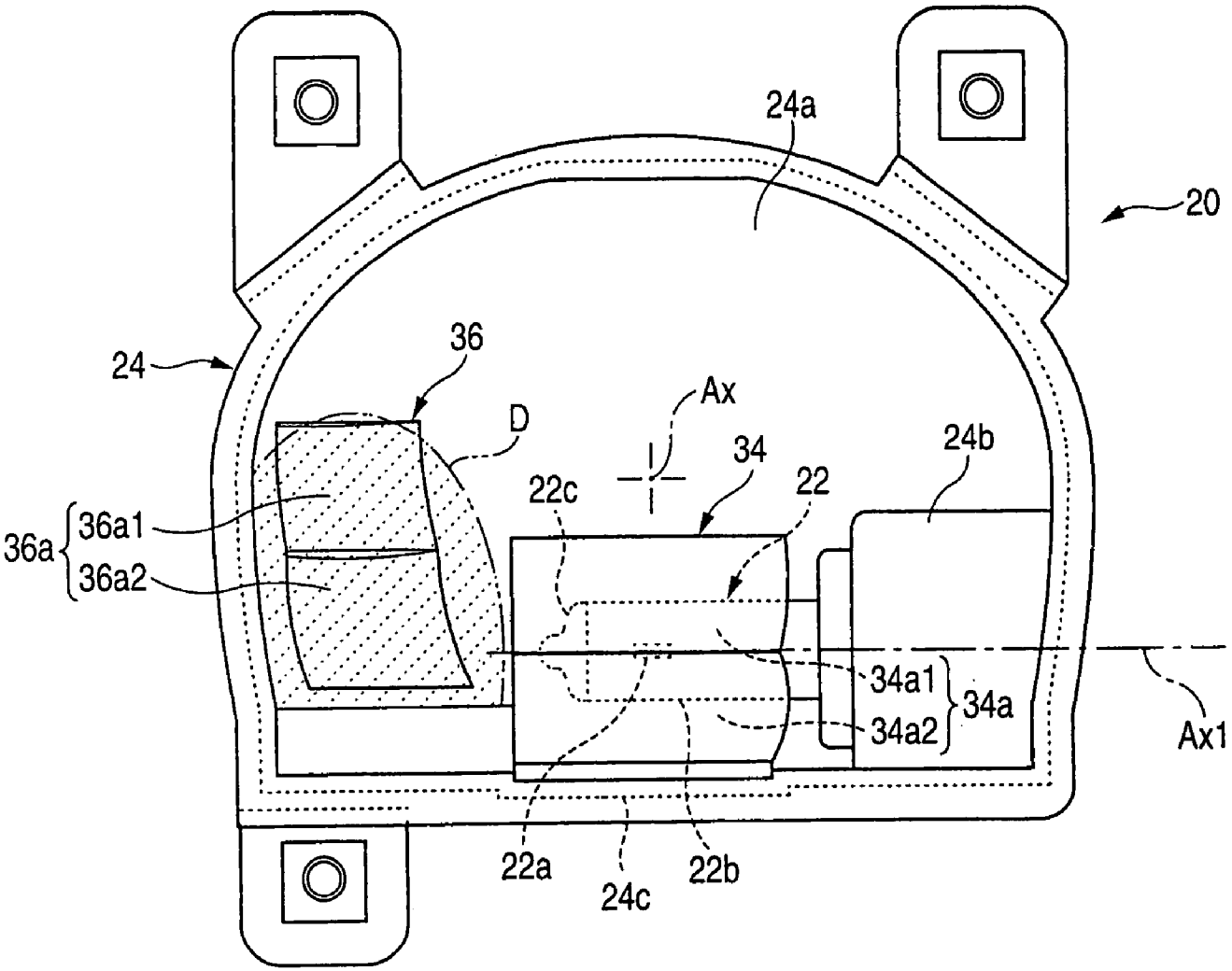
FIG. 4 is a front view showing a reflector of the lighting device unit, wherein a light source bulb and a first addition reflector are attached to the main reflector.

FIG. 4 is a front view showing the main reflector 24 of the lighting device unit 20 to which the light source bulb 22 and the first addition reflector 34 are attached.

As shown in the drawing, the light bulb 22 includes a black top. That is, light emitted from the light source 22*a* forward in the axial direction of the bulb of the transparent glass tube 22*b* is shaded by the shading film 22*c*. Therefore, as shown by the two-dotted chain line in the drawing, a dark portion D, upon which the light emitted from the light source 22*a* is not incident, is formed in the bulb inserting direction front region on the reflecting face 24*a* of the main reflector 24.

In this case, this dark portion D is formed so that an upper end edge of the dark portion D can be extended to an upper position of a plane containing the optical axis $A_x$. However, the reflecting face 36*a* of the second addition reflector 36 is formed so that it can substantially coincide with this dark portion D. Specifically, the upper stage reflecting portion 36*a*1 of the second addition reflector 36 is formed at a position on the side of the optical axis $A_x$. The lower stage reflecting portion 36*a*2 of the second addition reflector 36 is formed at a position adjacent to the lower side of this upper stage reflecting portion 36*a*1.

Figure 5:
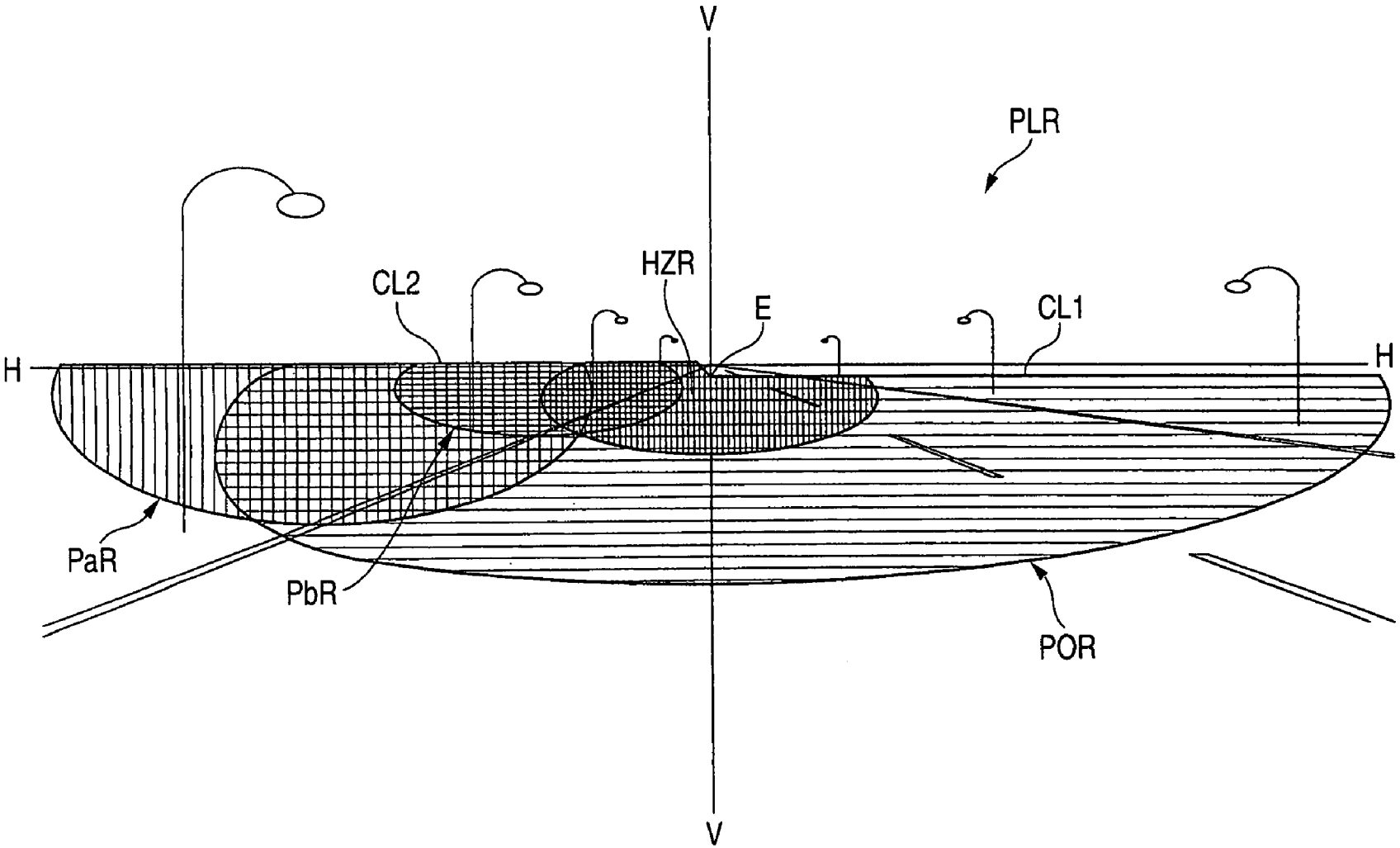
FIG. 5 is a perspective view showing a low beam light distribution pattern formed on a virtual perpendicular screen arranged at a position 25 m forward of the lighting device by the light irradiated in front by the headlamp described above.

FIG. 5 is a perspective view showing a low beam light distribution pattern formed on a virtual perpendicular screen arranged at a position 25 m in front of the lighting device by the light irradiated by the headlamp 10 of this exemplary embodiment.

This light distribution pattern PLR for a low beam is a composite light distribution pattern in which a basic light distribution pattern POR and two addition light distribution patterns $P_aR$ and $P_bR$ are compounded with each other.

The basic light distribution pattern POR is a light distribution pattern which forms a basic shape of the light distribution pattern PLR for a low beam. This basic light distribution pattern POR is formed by the reflected light sent from the main reflector 24.

This basic light distribution pattern POR is a light distribution pattern for a low beam which is distributed on the left. At an upper end edge of this basic light distribution pattern POR, cut-off lines CL1 and CL2, which are uneven with respect to the traverse direction, are provided. CL1 and CL2 extend in the horizontal direction in an uneven state with respect to the right and left while the line V-V passing through the point H-V, which is the focus in the front of the lighting device, is used as a boundary between CL1 and CL2. A portion on the opposite lane side, which is on the right of the line V-V, is formed as the lower stage cut-off line CL1, and a portion on the own lane side, which is on the left of the line V-V, is formed as the upper stage cut-off line CL2 which is raised by a step via an inclination portion from the cut-off line CL1 of the lower stage.

In this basic light distribution pattern POR, the elbow point E, which is a point of intersection of the lower stage cut-off line CL1 and the line V-V, is located at a lower position of H-V by an angle of 0.5° to 0.6°. The reason why the elbow point E is located at a lower position of H-V by an angle of 0.5° to 0.6° is that the optical axis $A_x$ extends downward with respect to the longitudinal direction of a vehicle by an angle of 0.5° to 0.6°. In this basic light distribution pattern POR, a hot zone HZR, which is a high luminous intensity region, is formed surrounding the elbow point E.

This basic light distribution pattern POR is formed as a reverse projection image of a light source image which is formed on the rear side focal face (that is, a focal face including the rear side focus F) of the projection lens 28 by the light sent from the light source 22*a* reflected by the main reflector 24. The cut-off lines CL1 and CL2 are formed as a reverse projection image of the upper end edge 32*a* of the shade 32. At this time, in the bulb inserting direction front region on the reflecting face 24*a* of the main reflector 24, the dark portion D, upon which the light sent from the light source 22*a* is not incident, is formed. Therefore, this basic light distribution pattern POR is formed into a light distribution pattern, the diffusion angle on the left of which is smaller than the diffusion angle on the right.

The addition light distribution pattern $P_a$R is a light distribution pattern additionally formed so as to reinforce the left diffusion region of the basic light distribution pattern POR. The addition light distribution pattern $P_a$R is formed as a reverse projection image of the light source image formed on the rear side focal face of the projection lens 28 by the light sent from the light source 22*a* successively reflected by the upper stage reflecting portion $\mathbf{34}_a\mathbf{1}$ of the first addition reflector 34 and the upper stage reflecting portion $\mathbf{36}_a\mathbf{1}$ of the second addition reflector 36. At this time, the upper stage reflecting portion $\mathbf{36}_a\mathbf{1}$ of the second addition reflector 36 reflects the light, which is sent from the upper stage reflecting portion $\mathbf{34}_a\mathbf{1}$ of the first addition reflector 34, as condensed light which substantially converges near the upper end edge 32*a* of the shade 32 with respect to the perpendicular direction. At the same time, the upper stage reflecting portion $\mathbf{36}_a\mathbf{1}$ of the second addition reflector 36 reflects the light as substantially parallel light with respect to the horizontal direction. Accordingly, this addition light distribution pattern $P_a$R has a relatively large light distribution pattern. Accordingly, when this addition light distribution pattern $P_a$R is added, a region on the left of a front road surface of a vehicle can be uniformly and widely irradiated by the lighting device.

On the other hand, the addition light distribution $P_b$R is a light distribution pattern which is additionally formed so as to reinforce the brightness of the left portion of the hot zone HZR of the basic light distribution pattern POR. The addition light distribution $P_b$R is formed as a reverse projection image of the light source image formed on the rear side focal face of the projection lens 28 by the light sent from the light source 22*a* which is successively reflected by the lower stage reflecting portion $\mathbf{34}_a\mathbf{2}$ of the first addition reflector 34 and the lower stage reflecting portion $\mathbf{36}_a\mathbf{2}$ of the second addition reflector 36. In this case, the lower stage reflecting portion $\mathbf{36}_a\mathbf{2}$ of the second addition reflector 36 reflects the reflected light, which is sent from the lower stage reflecting portion $\mathbf{34}_a\mathbf{2}$ of the first addition reflector 34, as condensed light which substantially converges near the upper end edge 32*a* of the shade 32 with respect to the perpendicular direction. At the same time, with respect to the horizontal direction, the lower stage reflecting portion $\mathbf{36}_a\mathbf{2}$ of the second addition reflector 36 reflects the reflected light as condensed light which substantially converges forward of the upper end edge 32*a* of the shade 32. Therefore, this addition light distribution pattern $P_b$R is a relatively small light distribution pattern, the shape of which is a rectangle laid along the upper stage cut-off line CL2. Accordingly, when this addition light distribution pattern $P_b$R is added, the hot zone HZR can be extended to the left and the visibility of a distant region on a road surface in the front of a vehicle can be enhanced.

As described above in detail, the lighting device unit 20 of the headlamp 10 of the present exemplary embodiment is a project or type lighting device unit having a shade 32. Because the light source bulb 22 is inserted and fixed into the main reflector 24 from the side of the optical axis $A_x$ extending in the longitudinal of a vehicle, a length of the lighting device in the longitudinal direction can be shortened and the entire lighting device can be made compact.

In the lighting device unit 20 of the present exemplary embodiment, the first addition reflector 34 is provided between the light source bulb 22 and the shade 32. The first additive reflector reflects the light sent from the light source 22*a* toward the bulb inserting direction front region on the reflecting face 24*a* of the main reflector 24. Further, the second addition reflector 36 for reflecting the reflected light sent from the first addition reflector 34 to the front while converging on the optical axis $A_x$ is provided at the bulb inserting direction front region on the reflecting face 24*a* of the main reflector 24. Therefore, the direct light sent from the light source 22*a*, which would be shaded by the shade 32, can be incident upon the projection lens 28 by using the first and the second addition reflectors 34, 36 so that the light can be effectively used as irradiation light for irradiating the front side.

Further, in the lighting device unit 20 of the present exemplary embodiment, since the light source 22*a* is a linear light source extending in the axial direction of the bulb axis $A_x$1, a light flux, the luminous intensity of which is the highest, to be sent in a direction perpendicular to the direction of the bulb axis can be utilized by the first and the second addition reflector 34, 36.

In this connection, in the present exemplary embodiment, when the front region in the bulb inserting direction on the reflecting face 24*a* of the main reflector 24 is the second addition reflector 36, it is impossible to utilize the light which is directly incident from the light source 22*a* upon the front region in the bulb inserting direction. However, this direct light has a light flux in the axial direction of the bulb that has a very low luminous intensity. Therefore, the light flux that can be utilized by the headlamp 10 can be greatly increased as a whole. Due to the foregoing, brightness of the light distribution pattern PLR for a low beam, which is formed by the irradiation light emitted from the headlamp 10 for vehicle use, can be sufficiently ensured.

Since the first addition reflector 34 is arranged between the light source bulb 22 and the shade 32, it is possible to prevent the reflected light, which is sent from the main reflector 24, from redundantly shaded by the first addition reflector 34.

As discussed above, in the headlamp 10 of the present exemplary embodiment, the reflecting face 34*a* of the first addition reflector 34 is divided into an upper stage reflecting portion 34*a*1 and a lower stage reflecting portion 34*a*2 which are arranged in an upper and a lower stage. The reflecting face 36*a* of the second addition reflector 36 is divided into an upper stage reflecting portion 36*a*1 and a lower stage reflecting portion 36*a*2 which are arranged in an upper and a lower stage. In this case, a surface shape of the upper stage reflecting portion 34*a*1 of the first addition reflector 34 is formed into an ellipsoid of revolution, the first focus of which is a position of the light source 22*a* and the second focus A of which is a position close to the upper stage reflecting portion 36*a*l between the upper stage reflecting portion 34*a*1 and the upper stage reflecting portion 36*a*1 of the second addition reflector 36. A surface shape of the lower stage reflecting portion 34*a*2 of the first addition reflector 34 is formed into an ellipsoid of revolution, the first focus of which is a position of the light source 22*a* and the second focus B of which is a position close to the lower stage reflecting portion 36*a*2 between the lower stage reflecting portion 34*a*2 and the lower stage reflecting portion 36*a*2 of the second addition reflector 36. Accordingly, the following operational effects can be provided.

On the assumption that a virtual light source is arranged in each second focus A, B, the surface shapes of the upper stage reflecting portion 36*a*1 and the lower stage reflecting portion 36*a*2, which compose the reflecting face 36*a* of the second addition reflector 36, can be set. Therefore, the light distribution control can be easily performed.

Further, the second focuses A and B of the ellipsoids of revolution, which compose the surface shapes of the upper stage reflecting portion 34*a*1 and the lower stage reflecting portion 34*a*2 on the reflecting face 34*a* of the first addition reflector 34, are set at positions which are separate from each other by a certain distance in the vertical direction. Therefore, it is possible to prevent the radiation heat generated by the light source 22*a* from concentrating upon one point. Due to this structure of the lighting device, the second addition reflector 36 is seldom heated to a high temperature. Therefore, it is possible to prevent the undercoat provided on the vapor-deposited film composing the reflecting face 36*a* from being quickly deteriorated by an influence of the radiation heat given by the light source.

As described above, according to the present exemplary embodiment, the projector type lighting device unit 20 employing a side insertion type lighting device structure provides a sufficiently bright light distribution pattern PLR for a low beam while an influence of heat on the lighting device component is effectively avoided.

Further, in the present exemplary embodiment, the light source bulb 22 is inserted and fixed into the main reflector 24 at a lower position distant from the optical axis $A_x$. Accordingly, it is possible to avoid providing the bulb inserting and fixing portion 24*b* in an optical axis side region on the reflecting face 24*a* of the main reflector 24. Therefore, the optical axis side region on the reflecting face 24*a* can be effectively used for controlling the light distribution. By the reflected light sent from this optical axis side region on the reflecting face 24*a*, the brightness of the diffusion region of the light distribution pattern PLR for a low beam can be sufficiently ensured.

The light source bulb 22 of the lighting device unit 20 can be a halogen lamp, which generates a considerably large amount of heat. Accordingly, if a halogen lamp is used, the structure of this exemplary embodiment is very effective. Further, this light source bulb 22 is a bulb having a black top. Therefore, by the existence of the shading film 22*c*, no light is incident from the light source 22*a* upon the bulb inserting direction front region on the reflecting face 24*a* of the main reflector 24. Accordingly, it is very effective to employ the structure of this exemplary embodiment.

Further, in the lighting device unit 20 of this embodiment, the second addition reflector 36 includes an upper stage reflecting portion 36*a*1 and a lower stage reflecting portion 36*a*2 which are arranged in the vertical direction. Therefore, the light distribution patterns formed by the reflected light of the upper stage reflecting portion 36*a*1 and the lower stage reflecting portion 36*a*2 can be easily formed into rectangular addition light distribution patterns $P_aR$ and $P_bR$ which are preferably used as a portion of the light distribution pattern PLR for a low beam.

In this case, the reflecting face 36*a* of the second addition reflector 36 is composed so that a degree of convergence of the reflecting light, which is sent from the lower stage reflecting portion 36*a*2 of the second addition reflector 36, upon the rear side focus F of the projection leans 28 can be larger than a degree of convergence of the reflecting light, which is sent from the upper stage reflecting portion 36*a*1 of the second addition reflector 36, upon the rear side focus F of the projection lens 28. Therefore, the following operational effects can be provided.

As compared with the reflected light sent from the lower stage reflecting portion 36*a*2 of the second addition reflector 36, the reflected light sent from the upper stage reflecting portion 36*a*1 has a wide angular range in which the reflected light can be incident upon the projection lens 28 without being shaded by the shade 34. Accordingly, when the degree of convergence of the reflected light, which is sent from the upper stage reflecting portion 36*a*1, upon the rear side focus F of the projection lens 28 is reduced, it is possible to form an addition light distribution pattern $P_aR$ for reinforcing the brightness of the diffusion region in the light distribution pattern PLR for a low beam which is originally to be formed by the reflected light sent from the bulb inserting direction front region on the reflecting face 24*a* of the reflector 24. On the other hand, it becomes relatively difficult to form an addition light distribution pattern for reinforcing the diffusion region on the light distribution pattern PLR for a low beam by the reflected light sent from the lower stage reflecting portion 36*a*2 of the second addition reflector 36. However, when the degree of convergence of the reflected light, which is sent from the lower stage reflecting portion 36*a*2, upon the rear side focus F of the projection lens 28 is increased, it is possible to form an addition light distribution pattern $P_bR$ for reinforcing the brightness in the periphery of the hot zone HZR on the light distribution pattern PLR for a low beam.

Especially, in the lighting device unit 20 of the present exemplary embodiment, the light source bulb 22 is inserted and fixed to the reflector 24 at a position downward a distance from the optical axis $A_x$, and the upper stage reflecting portion 36*a*1 of the second addition reflector 36 is located at a position substantially on the side of the optical axis $A_x$. Accordingly, the addition light distribution pattern $P_aR$ for reinforcing the brightness of the diffusion region on the light distribution pattern PLR for a low beam can be more easily formed by the reflected light sent from the upper stage reflecting portion 36*a*1.

Next, the first variation of the above embodiment will be explained below.

Figure 6:
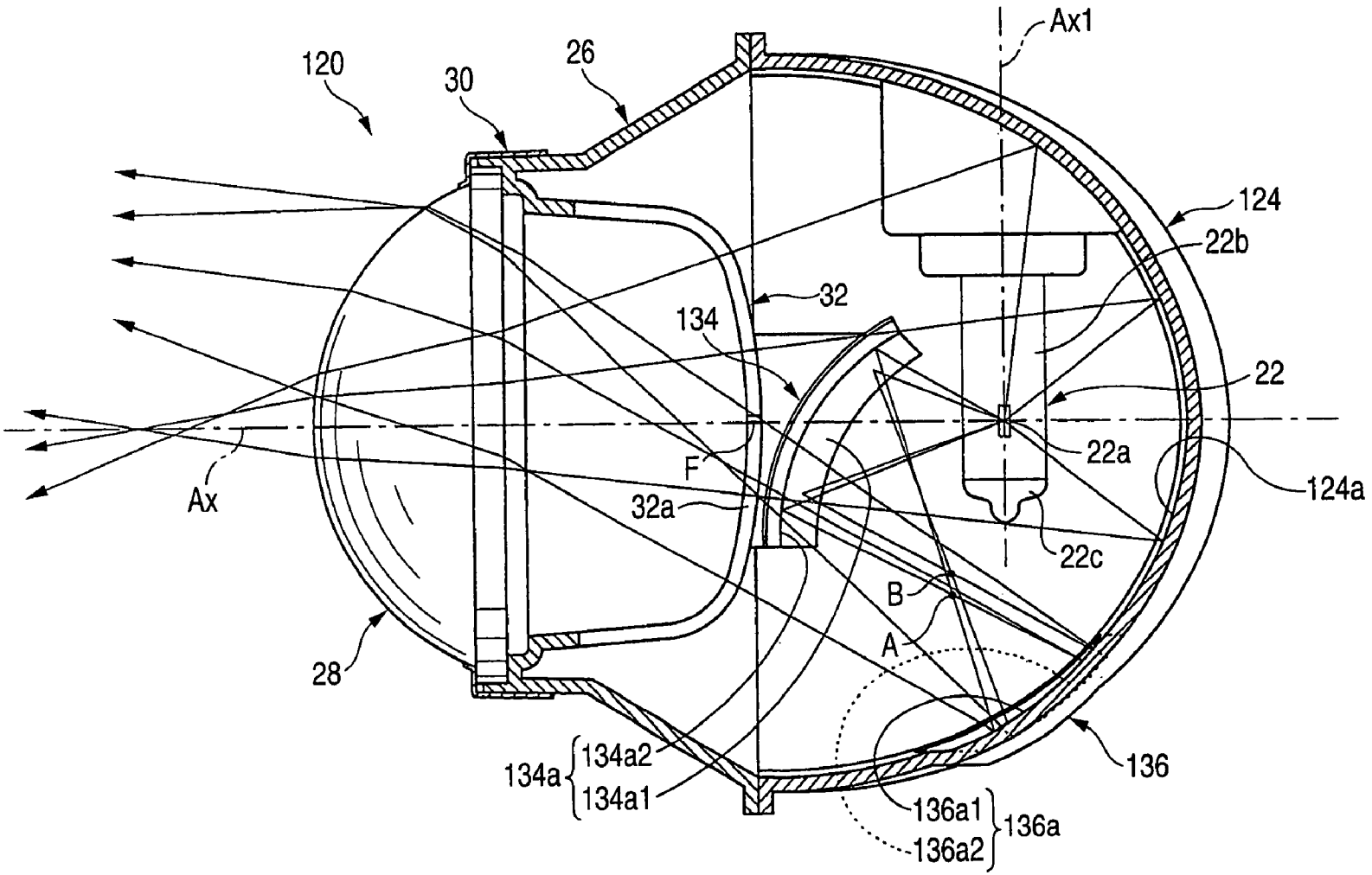
FIG. 6, which is the same view as FIG. 3, shows a first variation of the exemplary embodiment described above.

FIG. 6, which is the same view as FIG. 3, shows a lighting device unit 120 of this variation.

As shown in the drawing, the lighting device unit 120 of this variation is composed in such a manner that the light bulb inserting direction into the lighting device unit 20 is inverted with respect to the traverse direction.

Figure 7:
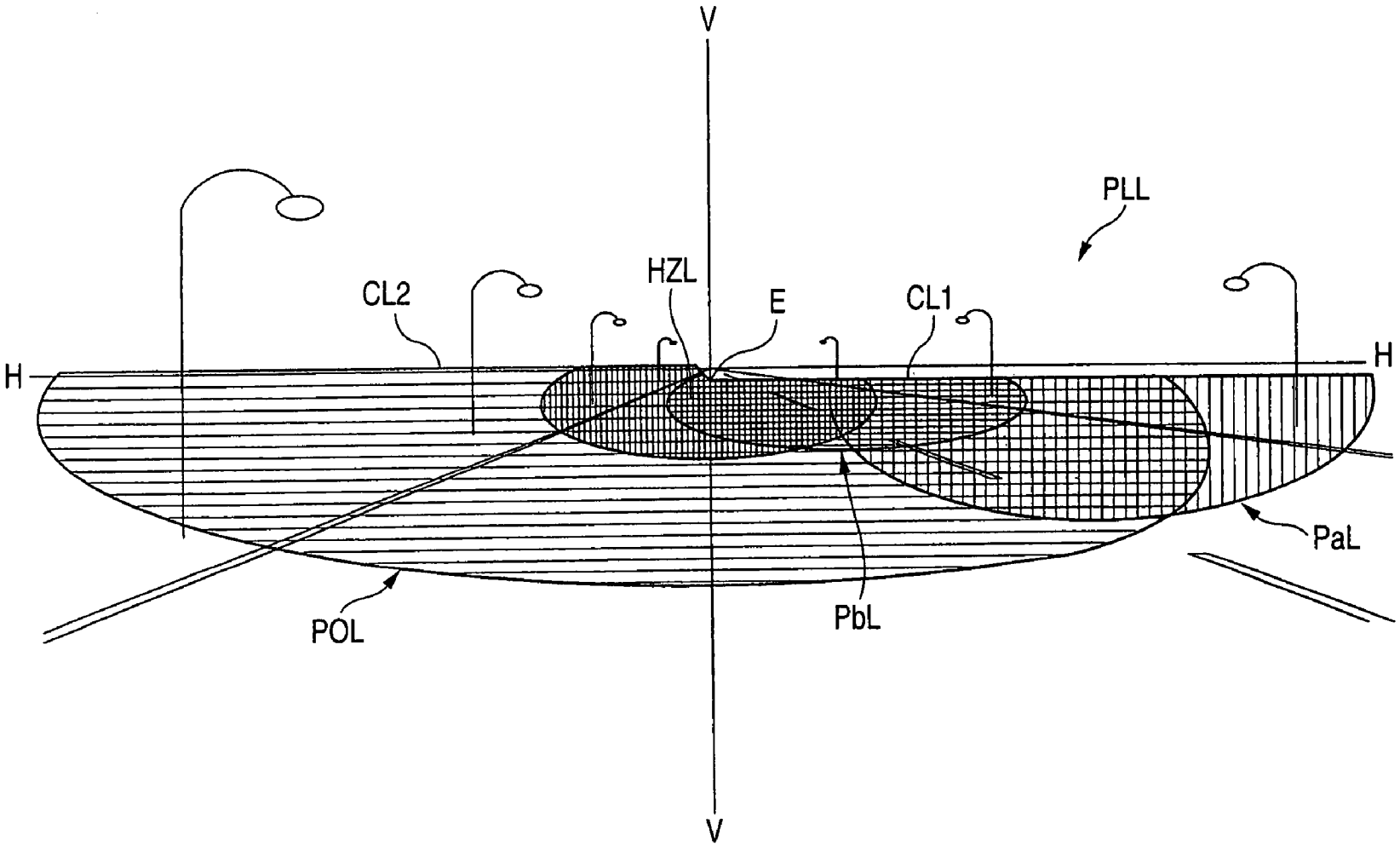
FIG. 7, which is the same view as FIG. 5, shows a light distribution pattern of the first variation.

In the exemplary embodiment described before, the diffusion region on the left of the basic light distribution pattern POR is reinforced by the addition light distribution pattern $P_aR$, and the hot zone HZR of the basic light distribution pattern POR is extended to the left by the addition light distribution pattern $P_bR$. However, when the structure of this variation is employed, as shown in FIG. 7, the diffusion region on the right of the basic light distribution pattern POL is reinforced by the addition light distribution pattern $P_aL$, and the hot zone HZL of the basic light distribution pattern POL is extended to the right by the addition light distribution pattern $P_bL$. The reason is described as follows. When the bulb inserting direction is inverted with respect to the traverse direction, optical paths of the light reflected by the reflector 124 and the first and the second addition reflector 134, 136 are located symmetrically with respect to the optical axis $A_x$. Therefore, an outside shape of the diffusion region of the basic light distribution pattern POL becomes symmetrical with respect to the case of the basic light distribution pattern POR. Further, the addition light distribution patterns $P_aL$ and $P_bL$ are formed at positions which are symmetrical with respect to the addition light distribution patterns $P_aR$ and $P_bR$.

In this case, the upper stage reflecting portion 134*a*1 and the lower stage reflecting portion 134*a*2, which compose the reflecting face 134*a* of the first addition reflector 134, and the upper stage reflecting portion 136*a*1 of the second addition reflector 136 are composed in such a manner that the structure of the above exemplary embodiment is inverted with respect to the traverse direction. Concerning the lower stage reflecting portion 136*a*2 of the second addition reflector 136, the lower stage reflecting portion 36*a*2 of the second addition reflector 36 of the above exemplary embodiment is also inverted with respect to the traverse direction. However, a degree of convergence of the reflected light is reduced slightly as compared with the case of the lower stage reflecting portion 36*a*2 and the convergence position is displaced slightly upward. Due to the foregoing, a size of the addition light distribution pattern $P_bL$ is increased slightly compared with that of the addition light distribution pattern $P_aR$ and is formed a downward slightly. Therefore, a light distribution pattern is formed which extends along the lower stage cut-off line CL1 from a neighborhood of the elbow point E to the opposite lane side.

When the lighting device unit 120 of this variation is applied to a headlamp for a vehicle, which is arranged at the left front end portion of a vehicle and turned on simultaneously with the lighting device unit 20 of the exemplary embodiment described above, it is possible to simultaneously form the light distribution pattern PLR for a low beam shown in FIG. 5 and the light distribution pattern PLL for a low beam shown in FIG. 7. Accordingly, it is possible to widely irradiate a road surface in the front of a vehicle in the traverse direction. Further, the hot zones HZR and HZL can be expanded onto both sides.

Next, a second variation of the exemplary embodiment described above will be explained below.

Figure 8:
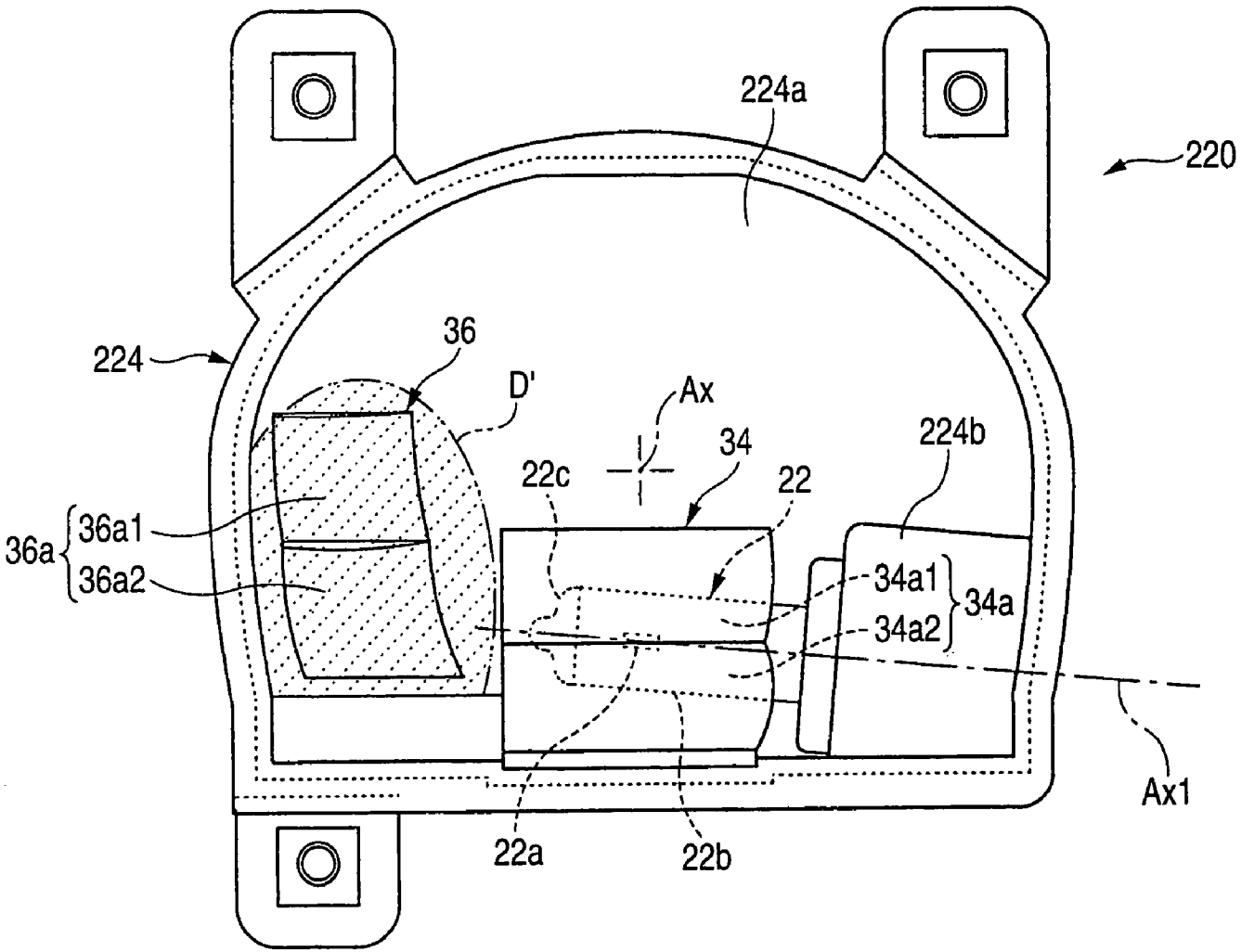
FIG. 8, which is the same view as FIG. 4, shows a second variation of the exemplary embodiment described above.

FIG. 8, which is the same view as FIG. 4, shows a lighting device unit 220 of this variation.

Concerning this lighting device unit 220, the inserting and fixing of the light source bulb 22 with respect to the reflector 224 is different from that of the exemplary embodiment described before.

In the exemplary embodiment described before, the light source bulb 22 is inserted and fixed to the reflector 24 in such a manner that the bulb axis $A_x$1 of the light source bulb 22 is extended in the horizontal direction on a plane which is perpendicular to the optical axis $A_x$. However, in this variation, the light source bulb 22 is inserted and fixed to the reflector 24 so that the bulb axis $A_x$1 of the light source bulb 22 is extended obliquely upward at an angle of 5° with respect to the horizontal direction on a plane which is perpendicular to the optical axis $A_x$. However, the light source 22*a* is positioned perpendicularly under the optical axis $A_x$ in the same manner as that of the exemplary embodiment described before. Although an inclination angle of the bulb axis is not particularly limited, it is preferable that the inclination angle of the bulb axis is set at a value in a range from 1° to 10° (for example, 5°).

In order to make this structure, a bulb inserting and fixing portion 224*b* formed in the left lower region of the reflecting face 224*a* of the reflector 224 is obliquely formed at a position displaced downward slightly compared with the bulb inserting and fixing portion 24*b* of the exemplary embodiment described above.

When the position of the bulb inserting and fixing portion 224*b* is lowered as described above, the left region of the optical axis $A_x$ of the reflecting face 224*a* of the reflector 224 can be more widely utilized for controlling the light distribution. Due to the foregoing, the brightness of the right diffusion region of the distribution pattern PLR for a low beam can be increased.

In this exemplary embodiment, the bulb axis $A_x$1 of the light source bulb 22 is inclined slightly upward. According to the inclination of the bulb axis $A_x$1 of the light source bulb 22, a dark portion D formed on the reflecting face 224*a* of the reflector 224 is also displaced upward as compared with the dark portion D of the exemplary embodiment described above. Due to the foregoing, an invalid region of the reflecting face 224*a* is expanded. Therefore, it is very effective to provide the reflecting face 36*a* of the second addition reflector 36 in the bulb inserting direction front region on the reflecting face 224*a* of the reflector 224.

While the invention has been described with reference to the exemplary embodiment and variations thereof, the technical scope of the invention is not restricted to the description of the exemplary embodiment and variations thereof. It is apparent to the skilled in the art that various changes or improvements can be made. It is apparent from the description of claims that the changed or improved configurations can also be included in the technical scope of the invention.

What is claimed is:

1. A headlamp for a vehicle, comprising:

a projection lens arranged on an optical axis extending in the longitudinal direction of a vehicle;

a light source arranged at the rear of a rear side focus of the projection lens, wherein the light source includes a linear light source extending in the axial direction of a light source bulb inserted and fixed to a main reflector from a side of the optical axis;

the main reflector for reflecting light, which is sent from the light source, toward a front side while the reflected light is converged toward the optical axis;

a shade, which is arranged near a rear side focus of the projection lens so that an upper end edge of the shade can be located close to the optical axis and which reflects a portion of the reflected light sent from the main reflector;

a first addition reflector for reflecting light, which is sent from the light source, to a front region in the bulb insertion direction, and the first addition reflector being arranged between the light source bulb and the shade; and a second addition reflector for reflecting light, which is reflected on the first addition reflector being sent from the light source, toward a front side while the reflected light is converged toward the optical axis, the second addition reflector being provided at a front region in the bulb insertion direction on a reflecting face of the main reflector;

wherein a reflecting face of the first addition reflector is divided into a plurality of reflecting portions, wherein a surface shape of each reflecting portion is formed into an ellipsoid of revolution, a first focus of which is a position of the light source and a second focus of which is another position between the first addition reflector and the second addition reflector, wherein the second focuses of the plurality of reflecting portions are different from one another; and wherein a reflecting face of the second addition reflector is divided into a plurality of reflecting portions, wherein the reflected light sent from the reflecting portions of the first addition reflector is incident upon the reflecting portions of the second additional reflector.

2. The headlamp according to claim 1, wherein the light source bulb is inserted and fixed to the main reflector at a position downward a distance from the optical axis.

3. The headlamp according to claim 1, wherein the light source bulb is a halogen bulb.

4. The headlamp according to claim 2, wherein the light source bulb is a halogen bulb.

5. The headlamp according to claim 1, wherein the light source bulb includes:

a transparent glass tube covering the light source, and a black top in which a shade film is formed at a forward end portion in the axial direction of the bulb of the transparent glass tube covering the light source.

6. The headlamp according to claim 3, wherein the light source bulb includes:

a transparent glass tube covering the light source, and a black top in which a shade film is formed at a forward end portion in the axial direction of the bulb of the transparent glass tube covering the light source.

7. The headlamp according to claim 2, wherein the light source bulb is inserted and fixed to the reflector so that a bulb axis of the light source bulb is obliquely inclined upward with respect to the horizontal direction.

8. The headlamp according to claim 4, wherein the light source bulb is inserted and fixed to the reflector so that a bulb axis of the light source bulb is obliquely inclined upward with respect to the horizontal direction.

9. The headlamp according to claim 1, wherein:

the reflecting faces of the first and the second addition reflect or respectively include an upper stage reflecting portion and a lower stage reflecting portion, which are arranged in an upper portion and a lower portion, and reflecting light sent from the upper stage reflecting portion of the first addition reflector is incident upon the upper stage reflecting portion of the second addition reflector, and reflecting light sent from the lower stage reflecting portion of the first addition reflector is incident upon the lower stage reflecting portion of the second addition reflector.

10. The headlamp according to claim 2, wherein:

the reflecting faces of the first and the second addition reflector respectively include an upper stage reflecting portion and a lower stage reflecting portion, which are arranged in an upper portion and a lower portion, and reflecting light sent from the upper stage reflecting portion of the first addition reflector is incident upon the upper stage reflecting portion of the second addition reflector, and reflecting light sent from the lower stage reflecting portion of the first addition reflector is incident upon the lower stage reflecting portion of the second addition reflector.

11. The headlamp according to claim 3, wherein:

the reflecting faces of the first and the second addition reflector respectively include an upper stage reflecting portion and a lower stage reflecting portion, which are arranged in an upper portion and a lower portion, and reflecting light sent from the upper stage reflecting portion of the first addition reflector is incident upon the upper stage reflecting portion of the second addition reflector, and reflecting light sent from the lower stage reflecting portion of the first addition reflector is incident upon the lower stage reflecting portion of the second addition reflector.

12. The headlamp according to claim 8, wherein:

the reflecting faces of the first and the second addition reflector respectively include an upper stage reflecting portion and a lower stage reflecting portion, which are arranged in an upper portion and a lower portion, and reflecting light sent from the upper stage reflecting portion of the first addition reflector is incident upon the upper stage reflecting portion of the second addition reflector, and reflecting light sent from the lower stage reflecting portion of the first addition reflector is incident upon the lower stage reflecting portion of the second addition reflector.

13. The headlamp according to claim 9, wherein the reflecting face of the second addition reflector is composed so that a degree of convergence of the reflecting light, which is sent from the lower stage reflecting portion of the second addition reflector, upon the rear side focus of the projection lens is larger than a degree of convergence of the reflecting light, which is sent from the upper stage reflecting portion of the second addition reflector, upon the rear side focus of the projection lens.

14. The headlamp according to claim 10, wherein the reflecting face of the second addition reflector is composed so that a degree of convergence of the reflecting light, which is sent from the lower stage reflecting portion of the second addition reflector, upon the rear side focus of the projection lens is larger than a degree of convergence of the reflecting light, which is sent from the upper stage reflecting portion of the second addition reflector, upon the rear side focus of the projection lens.

15. The headlamp according to claim 11, wherein the reflecting face of the second addition reflector is composed so that a degree of convergence of the reflecting light, which is sent from the lower stage reflecting portion of the second addition reflector, upon the rear side focus of the projection lens is larger than a degree of convergence of the reflecting light, which is sent from the upper stage reflecting portion of the second addition reflector, upon the rear side focus of the projection lens.

16. The headlamp according to claim 12, wherein the reflecting face of the second addition reflector is composed so that a degree of convergence of the reflecting light, which is sent from the lower stage reflecting portion of the second addition reflector, upon the rear side focus of the projection lens is larger than a degree of convergence of the reflecting light, which is sent from the upper stage reflecting portion of the second addition reflector, upon the rear side focus of the projection lens.

17. The headlamp according to claim 4, wherein the light source bulb includes:

a transparent glass tube covering the light source, and a black top in which a shade film is formed at a forward end portion in the axial direction of the bulb of the transparent glass tube covering the light source.

18. The headlamp according to claim 17, wherein the reflecting faces of the first and the second addition reflector respectively include an upper stage reflecting portion and a lower stage reflecting portion, which are arranged in an upper portion and a lower portion, and reflecting light sent from the upper stage reflecting portion of the first addition reflector is incident upon the upper stage reflecting portion of the second addition reflector, and reflecting light sent from the lower stage reflecting portion of the first addition reflector is incident upon the lower stage reflecting portion of the second addition reflector.

19. The headlamp according to claim 4, wherein the reflecting faces of the first and the second addition reflector respectively include an upper stage reflecting portion and a lower stage reflecting portion, which are arranged in an upper portion and a lower portion, and reflecting light sent from the upper stage reflecting portion of the first addition reflector is incident upon the upper stage reflecting portion of the second addition reflector, and reflecting light sent from the lower stage reflecting portion of the first addition reflector is incident upon the lower stage reflecting portion of the second addition reflector.

20. The headlamp according to claim 19, wherein the reflecting face of the second addition reflector is composed so that a degree of convergence of the reflecting light, which is sent from the lower stage reflecting portion of the second addition reflector, upon the rear side focus of the projection lens is larger than a degree of convergence of the reflecting light, which is sent from the upper stage reflecting portion of the second addition reflector, upon the rear side focus of the projection lens.

* * * * *